US005242015A

United States Patent [19]

Saperstein et al.

[11] Patent Number: 5,242,015

[45] Date of Patent: Sep. 7, 1993

[54] HEAT EXCHANGER

[75] Inventors: Zalman P. Saperstein, Lake Bluff, Ill.; Gregory G. Hughes, Milwaukee; Leon A. Guntly, Racine, both of Wis.

[73] Assignee: Modine Manufacturing Co., Racine, Wis.

[21] Appl. No.: 748,673

[22] Filed: Aug. 22, 1991

[51] Int. Cl.[5] ..... F28D 7/04; F28D 7/10

[52] U.S. Cl. ..... 165/163; 165/164

[58] Field of Search ..... 165/154, 163, 164, 177

[56] References Cited

U.S. PATENT DOCUMENTS

| | | | |
|---|---|---|---|
| 1,945,287 | 1/1934 | Monroe | 165/163 X |
| 2,014,919 | 9/1935 | Zellhoefer | 165/164 X |
| 2,129,300 | 9/1938 | Bichowsky | 165/163 |
| 2,657,018 | 10/1953 | Simpelaar | 165/163 X |
| 2,809,019 | 10/1957 | Newton | 165/163 X |

FOREIGN PATENT DOCUMENTS

| | | | |
|---|---|---|---|
| 210774 | 3/1957 | Australia | 165/81 |
| 1396469 | 3/1965 | France | 165/164 |
| 55-162597 | 12/1980 | Japan | 165/164 |
| 1-312391 | 12/1989 | Japan | 165/177 |
| 562864 | 7/1944 | United Kingdom | 165/154 |

*Primary Examiner*—Allen J. Flanigan

*Attorney, Agent, or Firm*—Wood, Phillips, VanSanten, Hoffman & Ertel

[57] ABSTRACT

The high cost of fabricating heat exchangers having two fluid flow paths in countercurrent or cross current relation is minimized by utilizing an extrusion (14) wound upon itself with adjacent convolutions (16, 18, 20, 24) spaced at (26) and located within a housing (10). A baffle (56) or a seal (82, 84) are employed within the housing (10) to respectively define cross current or countercurrent heat exchangers. Alternatively, an extrusion such as a unitary extrusion (100) may contain plural flow paths (114, 120, 122) or an extrusion made up of two extrusions (150, 152) bonded together and having flow paths (162, 164) may be employed.

6 Claims, 4 Drawing Sheets

HEAT EXCHANGER

FIELD OF THE INVENTION

This invention relates to heat exchangers, and more particularly, to evaporators that operate to exchange heat between a primary refrigerant which undergoes vapor compression in a conventional refrigeration cycle of evaporation, compression, condensation and expansion, and a secondary refrigerant which is a liquid that is cooled by the primary refrigerant.

BACKGROUND OF THE INVENTION

Over the years, various counterflow or cross-flow types of heat exchangers have been employed in any of a variety of heat exchange operations. One type of counterflow heat exchanger employs generally concentric tubes or pipes with one heat exchange fluid flowing in the inner tube in a given direction and the other heat exchange fluid flowing in a space between the inner tube and the inner wall of the outer tube and in the opposite direction. In some instances, these heat exchangers have been made of rigid pipe to have one or more passes with the passes being connected together by conventional pipe fittings.

In other instances, flexible tubing has been wound in a continuous length with fittings applied to their ends. In one such heat exchanger, inner copper tubes and outer steel tubes are formed together in one continuous piece without joints and the fittings applied to their ends.

While these constructions work well for their intended purposes, the use of rigid pipes with pipe fittings is labor intensive in terms of assembly while forming concentric tubes together in one continuous piece requires sophisticated equipment such that the product is expensive.

The present invention is directed to overcoming one or more of the above problems.

SUMMARY OF THE INVENTION

It is the principal object of the invention to provide a new and improved heat exchanger which may be of the counterflow type or of the cross flow type for highly efficient heat exchange and which may be made relatively inexpensively.

It is also an object of the invention to provide such a heat exchanger particularly suited for use as an inexpensively fabricated evaporator.

According to one facet of the invention, there is provided a heat exchanger made up of an elongated extrusion means having opposed ends and at least two side-by-side internal, hydraulically discrete channels extending from end to end of the extrusion means. First and second port defining fittings are located at opposed ends of the extrusion means and are in fluid communication with one of the channels; and third and fourth port defining fittings are at opposite ends of the extrusion means and in fluid communication with another of the channels. The extrusion means is wrapped or folded about itself.

As a result of this construction, the heat exchanger is readily fabricated of easily producible elements, principally, easily formed extrusions.

In one embodiment, the extrusion means is formed of two separate extrusions in abutting relation, one of the extrusions containing the one channel and the other of the extrusions containing the other channel.

According to another embodiment of the invention, the extrusion means is defined by a single extrusion containing both of the channels.

According to the invention, the extrusion means has a cross section that is somewhat oval- or rectangular-like to have a major axis and a minor axis and the channels have major axes that are generally parallel to the major axis of the cross section of the extrusion means. Strengthening webs are located within the channels and extend across the same.

The invention also contemplates that the extrusions means be a single extrusion with at least three channels. Alternate ones of the channels are in fluid communication with corresponding ones of the first and second fittings and the third and fourth fittings.

According to another facet of the invention, there is provided a heat exchanger which includes an extrusion of flattened cross section wound upon itself with adjacent convolutions spaced from one another to define a wound structure having an open center, an outer periphery and opposed sides. A fluid channel is located within the extrusion and a fluid tight housing contains the extrusion. A pair of primary fluid ports enter the housing and are in fluid communication with respective ends of the fluid channel. A secondary fluid inlet is provided to the housing along with a secondary fluid outlet from the housing. Means are located within the housing for causing secondary fluid flowing from the inlet to the outlet to pass through the spaces between the adjacent convolutions of the extrusion.

In one embodiment, the inlet and the outlet are on opposite sides of the wound structure and the causing means includes a baffle in the open center of the wound structure.

According to another embodiment, one of the inlet and the outlet open to the open center of the wound structure and the other of the inlet and the outlet open to the outer periphery of the wound structure. The causing means comprises means sealing the opposed sides to the housing.

Other objects and advantages will become apparent from the following specification taken in connection with the accompanying drawings.

DESCRIPTION OF THE PREFERRED EMBODIMENTS

Figure 1:
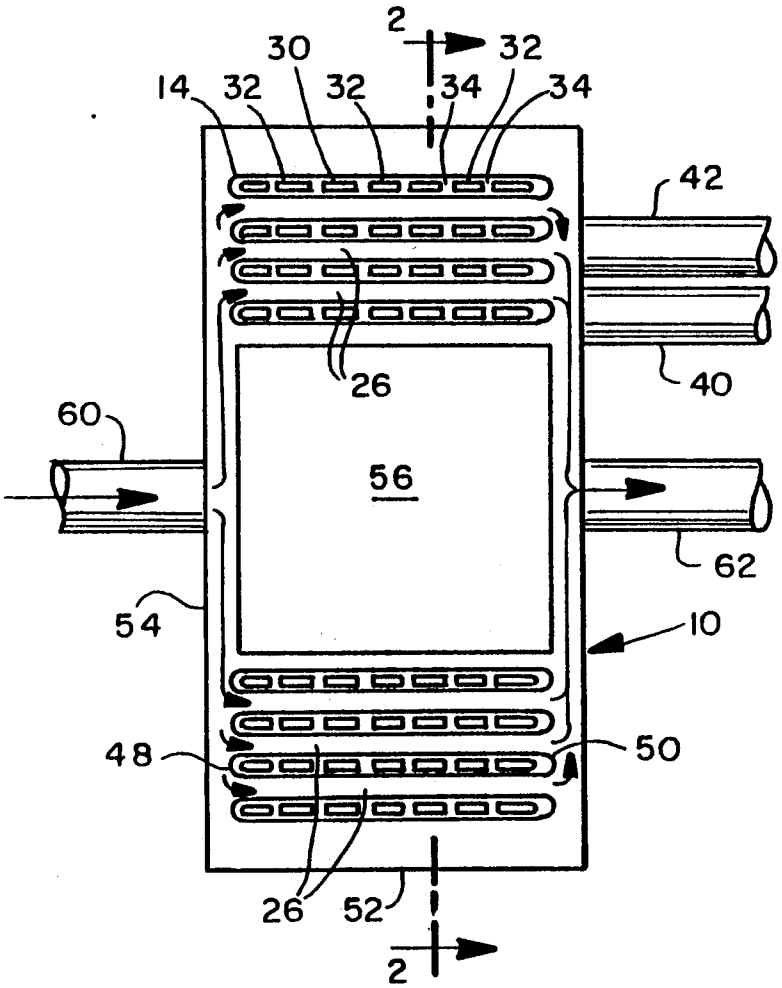
FIG. 1 is a sectional view of one embodiment of a heat exchanger made according to the invention and taken approximately along the line 1—1 in FIG. 2.
Figure 2:
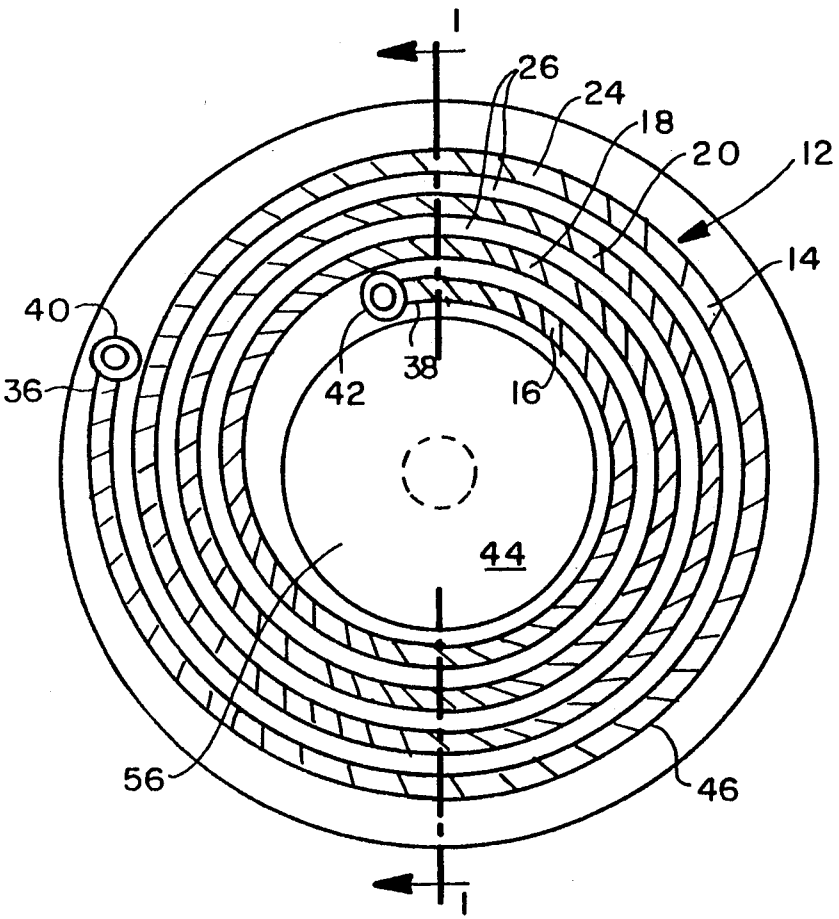
FIG. 2 is a sectional view of the heat exchanger taken approximately along the line 2—2 in FIG. 1.

One embodiment of a heat exchanger made according to the invention is illustrated in FIGS. 1 and 2 and with reference thereto is seen to include two basic components. A first is a liquid tight or sealed housing, generally designated 10 which, as illustrated, is in the form of a cylinder. A second major component is a core, generally designated 12, which is contained within the housing 10.

As can be seen in FIG. 2, the core 12 is made up of an elongated extrusion 14 of any suitable material, although typically aluminum will be employed. The extrusion 14 is wound so that adjacent convolutions 16, 18, 20 and 24 have small spaces 26 existing between such convolutions. Any suitable spacing means may be employed.

As can be seen in FIG. 1, the extrusion 14 is a flattened extrusion and includes an interior channel 30 made up of a plurality of passages 32 separated from one another by webs 34. The channel 30 extends from one end 36 of the extrusion to the opposite end 38 thereof and opens in fluid communication into tubular fittings 40 and 42. As seen in FIG. 1, the fittings 40 and 42 extend to the exterior of the housing 10.

In the usual case, the webs 34 will be such that the passages 32 are discrete and in hydraulic parallel with one another to define the channel 30. That is to say, the channel 30 is made up of a plurality of parallel passages 32. However, such is not absolutely necessary although generally speaking, depending upon the application to which the heat exchanger is put, it will be desirable to have the webs 34. The webs 34 serve as strengthening means which in turn serve to prevent the heat exchange fluid within the channel 30 from expanding the extrusion to possibly rupture or burst and increase the area available for heat transfer.

In the preferred embodiment, the core 12 is defined by a spiral wrapping of the extrusion 14 as can be seen in FIG. 2. The same has an open center 44, an outer periphery 46, and opposed sides 48 and 50 (FIG. 1).

The housing 10 has a cylindrical wall 52 and opposed end walls 54 and 56 which are adjacent to, but spaced from the sides 48 and 50 of the core 12 in this embodiment.

A plug or central baffle 56 is located in the central opening 44 of the core 12 in spaced relation to the housing walls 54 and 56.

Centered axially of the cylindrical wall 52, one end wall 54 includes an inlet port 60 while the other end wall 56 includes an outlet port 62. As can be seen by the unnumbered arrows appearing in FIG. 1, one heat exchange fluid enters the housing 10 through the port 60 and moves radially outwardly by reason of the presence of the baffle 56 to ultimately flow through the spaces 26 between adjacent convolutions of the extrusion 14 to the opposite side of the core 12 to return to the center and exit via the outlet 62. Where the heat exchanger is being utilized as an evaporator, this flow path will typically be occupied by the secondary fluid.

Primary refrigerant may be introduced at either of the fittings 40 or 42 and taken from the structure at the other one of such fittings.

It will be readily appreciated that a highly efficient and inexpensively fabricated cross flow heat exchanger is provided by the embodiment of FIGS. 1 and 2.

It should also be noted that through the use of the extrusion 14 as a means for containing the primary refrigerant, high efficiencies may be obtained. As is well-known, many air-fluid evaporators are made today, primarily for use in vehicular air-conditioning systems, of aluminum extrusions. Thus, the technology to optimize the passages 32 making up the channel 50 and the webs 34 to achieve highly efficient, primary refrigerant side heat exchange is well-known throughout the heat exchange industry.

Figure 3:
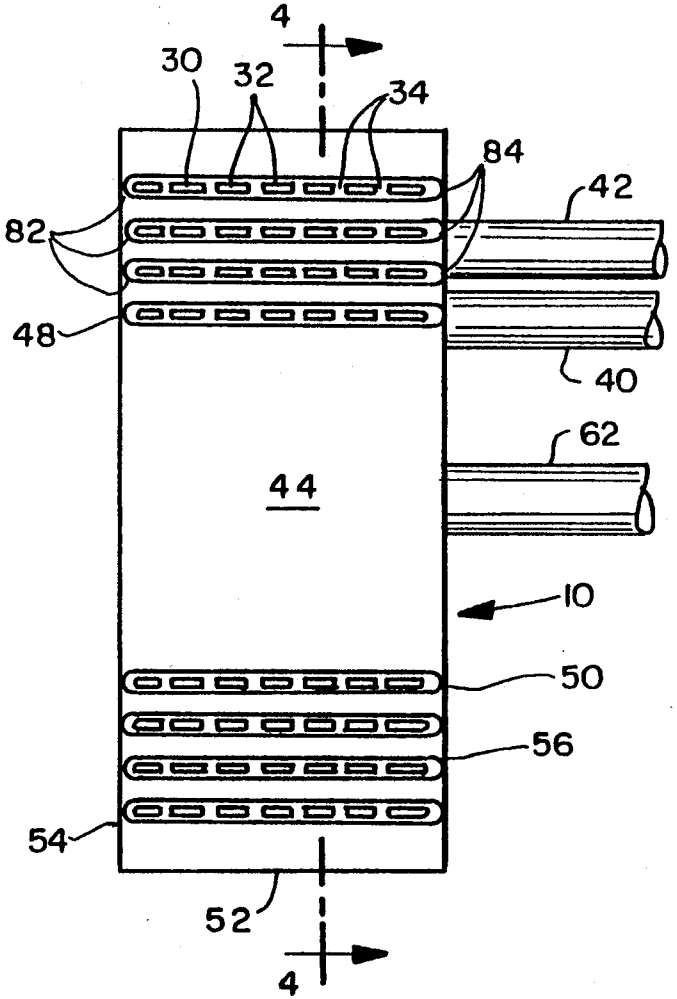
FIG. 3 is a view similar to FIG. 1, but of a first modified embodiment of the invention.
Figure 4:
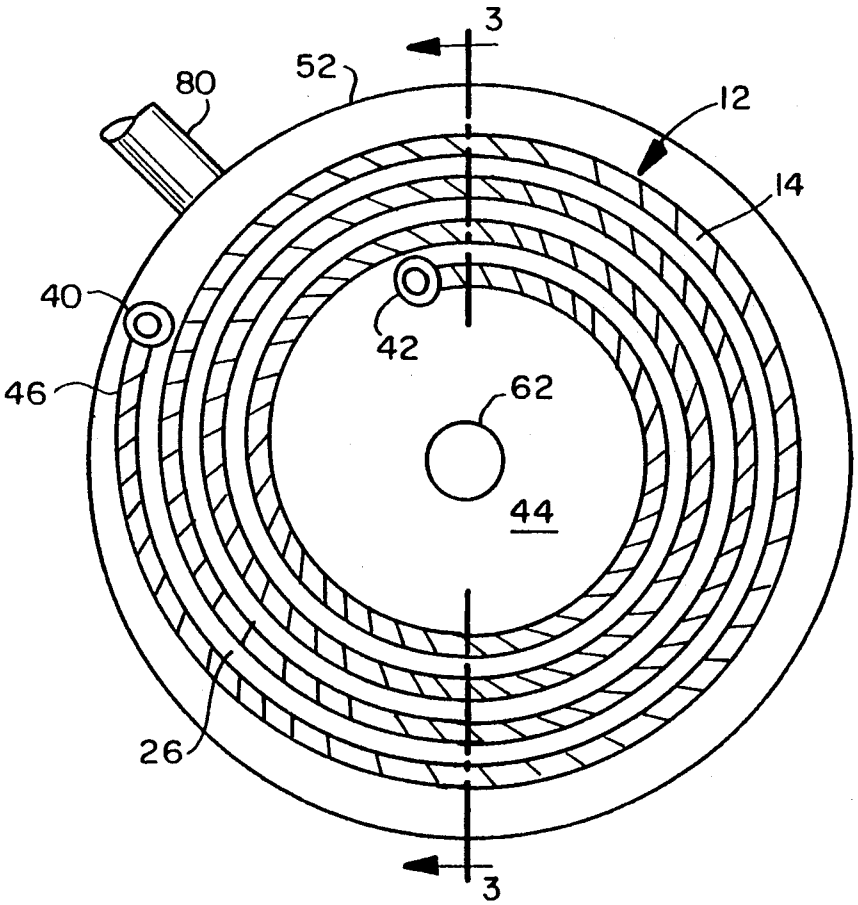
FIG. 4 is a view similar to FIG. 2, but of the first modified embodiment of the invention.

Turning now to FIGS. 3 and 4, a very similar heat exchanger, but one operating on the counterflow principle, is illustrated. In the interest of brevity, where like components are employed, like reference numerals will be utilized.

In particular, a housing 10 having a cylindrical wall 52 and opposed end walls 54 and 56 is employed as before. Contained within the fluid tight housing 10 is a core, generally designated 12, which is identical to the core heretofore described except that the distance between opposite sides 48 and 50 of the wound structure is equal to the distance between the interior sides of the walls 54 and 56 for purposes to be seen.

The core 12 is provided with fittings 40 and 42 and the port 62 on the housing is retained.

However, the baffle 56 within the open center 44 of the core 12 is dispensed with, as is the port 60. In lieu of the port 60, the cylindrical side wall 52 is provided with a port 80 which preferably opens to the outer periphery 46 of the core 12 in the vicinity of the fitting 40.

Finally, as can be best seen in FIG. 3, the sides 48 and 50 of the core 12 are in sealing engagement with corresponding ones of the side walls 54 and 56.

Depending upon any of a variety of factors, the sealing may be made by pure contact at the points shown at 82 and 84 in FIG. 3. Alternatively, an actual physical seal such as might be provided by caulking material could be employed. As still another alternative, it is possible that the seal may be formed simply by bonding as, by brazing or soldering, the sides 48 and 50 of the core 12 to the respective walls 54 and 56 of the housing 10.

In this embodiment, it will also be desirable to introduce the primary refrigerant into the interior of the extrusion 14 through one of the ports 40 or 42. In this embodiment, the secondary refrigerant may be introduced into the port 80. It will be appreciated that for the secondary refrigerant to proceed to the outlet 62, it must pass through a spiraled path defined by the spaces 26 between adjacent convolutions to emerge at the open center 44 as it moves past the fitting 42. The sealing of the sides 48 and 50 of the core 12 against the interior of the housing 10 assure that the secondary refrigerant will follow this flow path.

Assuming the foregoing direction of flow for the secondary fluid, to obtain countercurrent flow in the heat exchanger, the primary refrigerant will then be introduced into the fitting 42 while the fitting 40 will serve as an outlet.

Again, an inexpensive heat exchanger which takes advantage of well-known technology to maximize vapor side heat exchange is provided.

In some instances, it may be desirable to avoid the use of a housing such as the housing 10 entirely. An embodiment accomplishing just that is illustrated in FIGS. 5-8 inclusive and with reference thereto is seen to include an extrusion 100 wound upon itself in a fashion generally similar to that mentioned previously. The extrusion 100 is elongated and includes a first pair of fittings 102 and 104 which are in fluid communication with one fluid channel for heat exchange fluid within the extrusion 100 and a second pair of fittings 106 and 108 which are in fluid communication with a second fluid channel within the extrusion 100.

Figure 6:
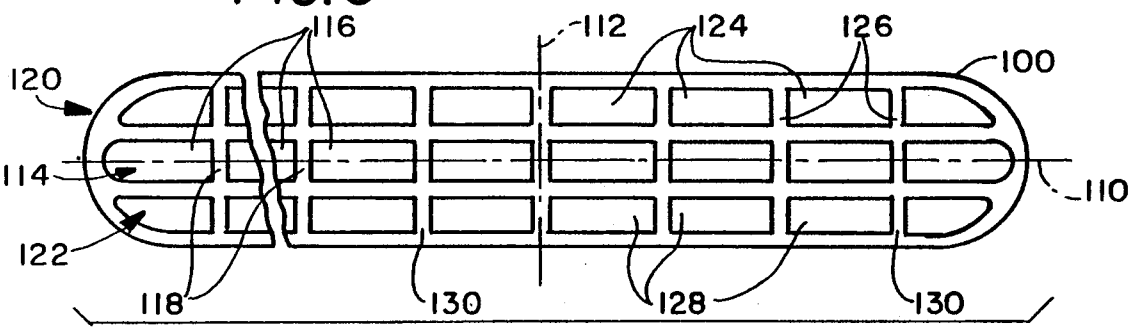
FIG. 6 is a sectional view of an extruded tube utilized in the embodiment of FIG. 5.

FIG. 6 illustrates a cross section of the extrusion 100. The extrusion 100 is elongated and as illustrated, is somewhat oval shaped in cross section. However, a rectangular, non-square shape would be equally satisfactory. The cross section illustrated in FIG. 6 thus has a major axis designated by the line 110 and a minor axis shown by the line 112.

In the illustrated embodiment, there are three channels within the extrusion 100, all having major axes parallel to the major axis 110. A first such channel is a central channel, generally designated 114 and made up of a plurality of passages 116 similar to the passages 32. The passages 116 are separated by strengthening webs 118.

Flanking the central channel 114 are two side channels, generally designated 120 and 122, respectively.

Like the channel 114, the channel 120 is made up of a series of passages 124 separated by webs 126 for strengthening purposes while the channel 122 is made up of a series of passages 128 and separating webs 130. In the usual case, the passages 116, 124 and 128 will be discrete and in hydraulic parallel with one another. However, that is not necessary so long as the strengthening function provided by the webs 126 is retained and the heat exchange surface provided by the webs is likewise present.

Figure 7:
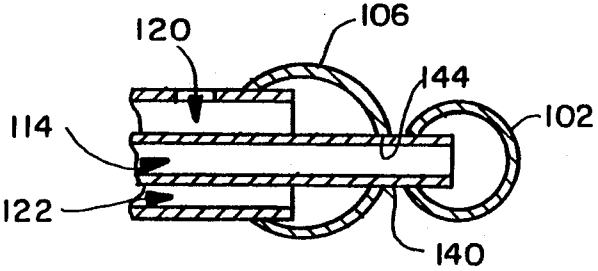
FIG. 7 is an enlarged, fragmentary sectional view of a port structure used with the embodiment of FIGS. 5 and 6.
Figure 8:
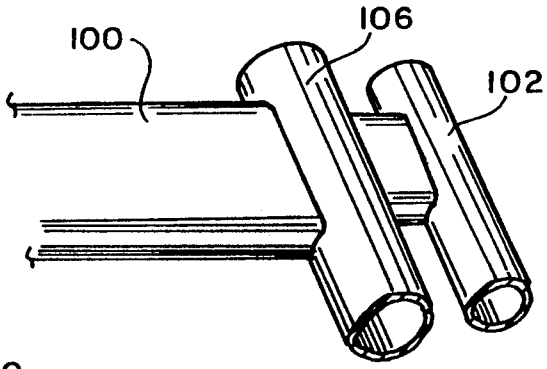
FIG. 8 is a fragmentary, perspective view of the port structure.
Figure 5:
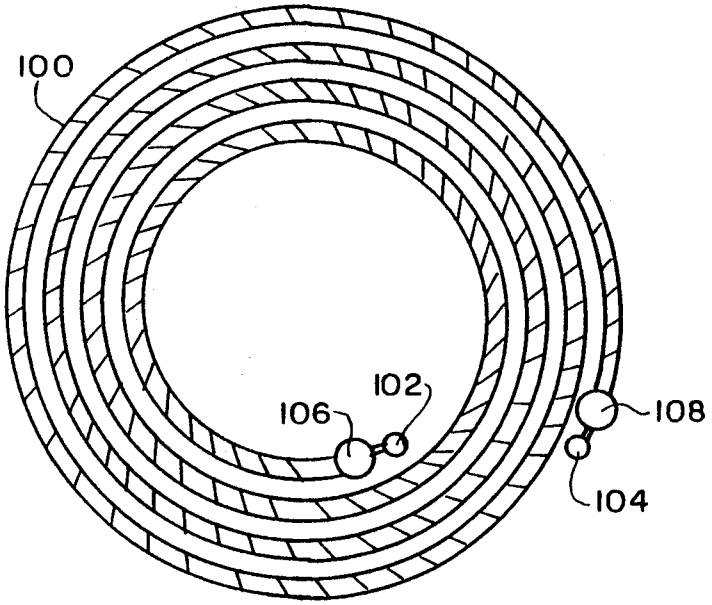
FIG. 5 is a view similar to FIGS. 2 and 4, but of a second modified embodiment of the invention.

At its ends, the extrusion 100 may have the channels 120 and 122 removed as illustrated in FIG. 7 so as to leave a projection 140 containing the channel 114 in existence. The fitting 106 may be made in tubular form and is bonded about the open ends of the channels 120 and 122. It may also be provided with an opening 144 through which the projection 140 may extend to in turn be received within the fitting 102.

The fittings 104 and 108 may be identical to the fittings 102 and 106.

In this embodiment of the invention, the primary refrigerant may be introduced into, for example, the fitting 106 to flow through the channels 120 and 122 and exit the heat exchanger at the fitting 108. To achieve countercurrent flow, the secondary refrigerant is introduced through the fitting 104 to flow in the opposite direction through the core to emerge from the same through the fitting 102.

Again, through the use of an extrusion and well-known techniques, the arrangement of the passages 124 and 128 and the webs 126 and 130 on the vapor or primary refrigerant side of the heat exchanger illustrated in FIGS. 5–8 can be easily engineered to maximize heat transfer.

Figure 9:
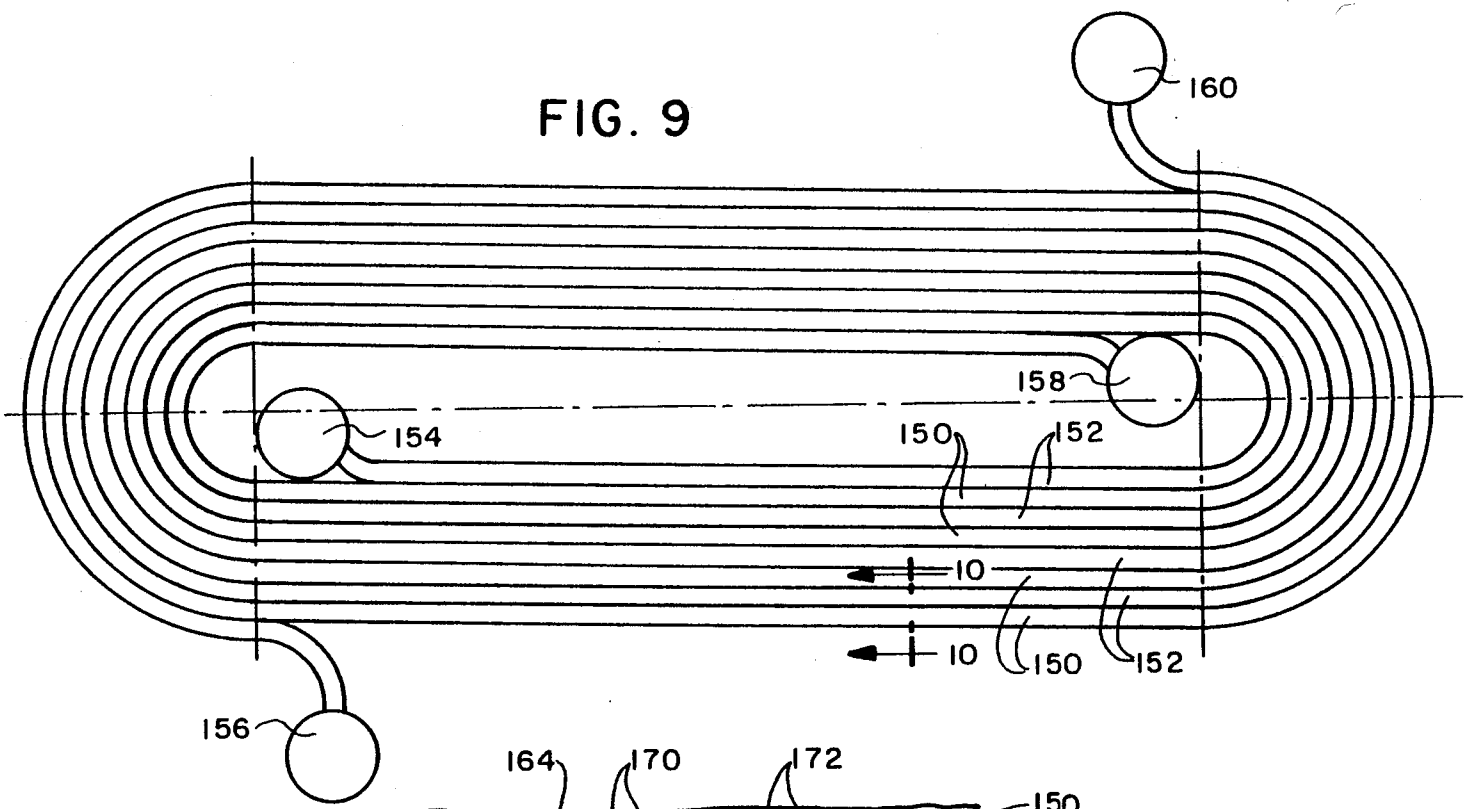
FIG. 9 is a plan view of still another modified embodiment of the invention.
Figure 10:
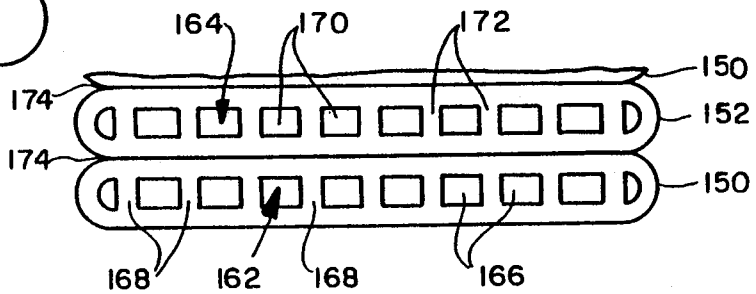
FIG. 10 is a sectional view taken approximately along the line 10—10 in FIG. 9.

Still another embodiment of the invention is illustrated in FIGS. 9 and 10. In this embodiment of the invention, there is the ability to a dispense with the housing 10 while using a less complex extrusion than the extrusion 100 employed in the embodiment of FIG. 6. This embodiment also illustrates that it is not necessary that the cores of the prior embodiments be formed of spirals, but that many other configurations are available.

In any event, the embodiment of FIG. 10 is made up of two elongated extrusions 150 and 152 that are wound upon one another in abutment and in heat exchange relationship with one another. At one end, the extrusion 152 includes a first port 154 while at its opposite end, it terminates in a port 156. The extrusion 150 has ports 158 and 160 associated therewith at its opposite ends.

As seen in FIG. 10, within each of the extrusions there is a flow channel. The extrusion 150 includes a flow channel generally designated 162 while the extrusion 152 includes an internal flow channel generally designated 164. The flow channel 162 is made up of a plurality of hydraulically discrete interior passages 166 separated by strengthening webs 168 while similar passages 170 and strengthening webs 172 make up the channel 164. Again, it is not absolutely necessary that the passages 166 and 170 be discrete so long as the conditions previously stated are adhered to.

In the usual case, one of the heat exchange fluids, say the primary refrigerant, is flowed through the channel 162 while the other heat exchange fluid, the secondary refrigerant, is flowed through the channel 164. In order to promote good heat exchange, it is necessary, as mentioned previously, that the extrusions 150 and 152 be in abutment with one another as illustrated in FIG. 10. Preferably, a metallurgical bond such as braze metal or solder shown as a layer 174 at the interfaces is present to maximize heat transfer between the adjacent extrusions.

Again, the invention enables one to take advantage of well-developed technology to maximize the primary refrigerant side heat exchange coefficient with inexpensive materials such as aluminum extrusions.

From the foregoing, it will be appreciated that the heat exchanger made according to the invention achieves the objects set forth previously.

We claim:

1. A heat exchanger comprising:

an extrusion of flattened cross section wound upon itself with adjacent convolutions spaced from one another to define a wound structure having an open center, an outer periphery and opposed sides;

a fluid channel within said extrusion;

a fluid tight housing containing said extrusion, said housing including a curved wall surrounding said outer periphery and joined to end walls which are adjacent to, but spaced from said opposed sides of said wound structure;

a pair of primary fluid ports entering said housing and in fluid communication with respective ends of said fluid channel;

a secondary fluid inlet to said housing located centrally in one said end wall and in general alignment with said open center;

a secondary fluid outlet from said housing including an opening in the other of said end walls, generally centrally thereof and aligned with said open center; and means, including a baffle, substantially closing said open center, for causing secondary fluid flowing from said inlet to said outlet to pass through the spaces between said adjacent convolutions.

2. The heat exchanger of claim 1 wherein said extrusion has a plurality of said fluid channels.

3. A heat exchanger comprising:

an elongated extrusion having opposed ends and at least two side-by-side internal, hydraulically discrete channels extending from end to end of said extrusion and in heat transfer relation with one another;

first and second port defining fittings at opposed ends of said extrusion and in fluid communication with one of said channels; and third and fourth port defining fittings at opposite ends of said extrusion and in fluid communication with another of said channels;

said extrusion being wrapped or folded about itself.

4. The heat exchanger of claim 3 wherein said extrusion includes at least three of said channels in side-by-side relation and in heat transfer relation with one another, two of said channels being in fluid communication with corresponding ones of said first and second fittings and a third of said channels being located between said two channels and being in fluid communication with said third and fourth fittings.

5. The heat exchanger of claim 4 wherein said extrusion, at said opposed ends, has said two channels removed with a projection containing said third channel.

6. The heat exchanger of claim 5 wherein said first and second fittings are tubular and bonded about ends of said two channels and provided with an opening through which said projection may extend; and said third and fourth fittings are received on said projections.

* * * * *

UNITED STATES PATENT AND TRADEMARK OFFICE

CERTIFICATE OF CORRECTION

PATENT NO. : 5,242,015

DATED : Sep. 7, 1993

INVENTOR(S) : Saperstein et al.

It is certified that error appears in the above-identified patent and that said Letters Patent is hereby corrected as shown below:

On title page, item [75], add

C. James Rogers
Racine, Wisconsin

Signed and Sealed this

Nineteenth Day of April, 1994

*Attest:*

*Attesting Officer*

BRUCE LEHMAN

*Commissioner of Patents and Trademarks*